US009620062B2

(12) United States Patent
Ma

(10) Patent No.: US 9,620,062 B2
(45) Date of Patent: Apr. 11, 2017

(54) PIXEL CIRCUIT, DRIVING METHOD THEREOF AND DISPLAY APPARATUS

(71) Applicant: BOE Technology Group Co., Ltd., Beijing (CN)

(72) Inventor: Zhanjie Ma, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 150 days.

(21) Appl. No.: 14/443,313

(22) PCT Filed: Aug. 29, 2014

(86) PCT No.: PCT/CN2014/085543
§ 371 (c)(1),
(2) Date: May 15, 2015

(87) PCT Pub. No.: WO2015/180278
PCT Pub. Date: Dec. 3, 2015

(65) Prior Publication Data

US 2016/0284273 A1 Sep. 29, 2016

(30) Foreign Application Priority Data

May 30, 2014 (CN) ..... 2014 1 0238690

(51) Int. Cl.
*G09G 5/00* (2006.01)
*G09G 3/3258* (2016.01)
*G09G 3/32* (2016.01)

(52) U.S. Cl.
CPC ..... *G09G 3/3258* (2013.01); *G09G 3/32* (2013.01); *G09G 2300/0426* (2013.01); *G09G 2310/08* (2013.01)

(58) Field of Classification Search
None
See application file for complete search history.

(56) References Cited

U.S. PATENT DOCUMENTS

2005/0280616 A1* 12/2005 Miwa ..... G09G 3/3233 345/77
2009/0140957 A1 6/2009 Park et al.
(Continued)

FOREIGN PATENT DOCUMENTS

CN 1744774 A 3/2006
CN 101645234 A 2/2010
(Continued)

OTHER PUBLICATIONS

May 5, 2016—(CN)—Second Office Action Appn 201410238690.4 with English Tran.
(Continued)

*Primary Examiner* — Andrew Sasinowski
*Assistant Examiner* — Henok Heyi
(74) *Attorney, Agent, or Firm* — Banner & Witcoff, Ltd.

(57) ABSTRACT

There is provided a pixel circuit, a driving method thereof and a display apparatus. The pixel circuit comprises a first transistor, a second transistor, a third transistor, a fourth transistor, a fifth transistors, a sixth transistor, a seventh transistor, a storage capacitor and a light-emitting element, it can solve the problem that a large difference exists between the data output from the Integrated Circuit and the data actually written to the pixel circuit and avoid the effect that the inconsistency or drift of the threshold voltage (Vth) of the third transistor and the IR drop of the initial voltage (V_initial) have on the current flowing through the light-emitting element.

20 Claims, 3 Drawing Sheets

(56) References Cited

U.S. PATENT DOCUMENTS

2011/0090137 A1* 4/2011 Liu ..... G09G 3/3233 345/76
2011/0090208 A1* 4/2011 Long ..... G09G 3/3233 345/211
2011/0115764 A1* 5/2011 Chung ..... G09G 3/3233 345/205
2011/0267319 A1 11/2011 Han
2013/0321249 A1* 12/2013 Kimura ..... G09G 3/3233 345/76
2014/0049568 A1* 2/2014 Qi ..... G09G 3/3258 345/690
2014/0253612 A1* 9/2014 Hwang ..... G09G 3/3258 345/691
2014/0292623 A1* 10/2014 Moon ..... G09G 3/006 345/82
2014/0306867 A1* 10/2014 Qing ..... G09G 3/3233 345/76
2014/0333513 A1* 11/2014 Park ..... G09G 3/3266 345/76
2015/0109189 A1* 4/2015 Hwang ..... G09G 3/3225 345/78
2015/0339974 A1* 11/2015 Wu ..... G09G 3/3233 345/690

FOREIGN PATENT DOCUMENTS

CN 102314829 A 1/2012
CN 103021333 A 4/2013

OTHER PUBLICATIONS

Ching-Lin Fan, et al., An AMOLED AC-Biased Pixel Design Compensating the Threshold Voltage and I-R Drop, International Journal of Photoenergy, vol. 2011 (2011), Article ID 543273, 6 pages.
Young-ju Park, et al., A New Voltage Driven Pixel Circuit for Large Sized AMOLED Panel, Department of Electronic and Electrical Engineering, Postech, Korea, IDW '04.
Oct 10, 2015—(CN)—First Office Action Appn 201410238690.4 with English Tran.

* cited by examiner

PIXEL CIRCUIT, DRIVING METHOD THEREOF AND DISPLAY APPARATUS

The application is a U.S. National Phase Entry of International Application No. PCT/CN2014/085543 filed on Aug. 29, 2014, designating the United States of America and claiming priority to Chinese Patent Application No. 201410238690.4, filed on May 30, 2014. The present application claims priority to and the benefit of the above-identified applications and the above-identified applications are incorporated by reference herein in their entirety.

TECHNICAL FIELD

The present disclosure relates to a pixel circuit, a driving method thereof and a display apparatus.

BACKGROUND

With the rapid development of display technique, the technique of the semiconductor elements as the core of a display apparatus has been developed rapidly. For the existing display apparatus, an Organic Light Emitting Diode (OLED), as a current-type light-emitting element, is increasingly applied to a field of a high performance display due to its features such as self-luminescence, rapid response, wide view angle, and the capability of being manufactured on a flexible substrate and the like. The OLEDs can be classified into two types, the Passive Matrix Driving OLED (PMOLED) and the Active Matrix Driving OLED(AMOLED). Since an AMOLED display has advantages such as low manufacturing cost, high response speed, power-saving, direct current driving applicable to a mobile device, a wide range of operating temperature, and the like, the AMOLED display is likely to replace the Liquid Crystal Display(LCD) to be a novel flat display of a next generation.

In an existing AMOLED display panel, each of OLEDs comprises a plurality of Thin Film Transistor(TFT) switching circuits. The TFT switching circuit manufactured on a glass substrate with a large size has non-uniformity on electrical parameters such as threshold voltage, mobility or the like due to limitation on production process, manufacturing level and the like, so that the current flowing through the AMOLED not only varies with the variation of the stress of the turn-on voltage generated when the TFT is in a ON state for a long time, but also varies with the drift of the threshold voltage of the TFT. As a result, the uniformity and the constancy on luminance of the display would be affected.

To address the above issues, as known by the inventor(s), in general, an AMOLED pixel compensation circuit would be adopted to compensate for the threshold voltage of TFT. Nevertheless, during the compensation phase, the sum of the data voltage and the threshold voltage(Vdata+Vth), or the sum of the power supply voltage and the threshold voltage (Vdd+Vth), would be written to the gate of the driving transistor. As a result, since the driving transistor is in a diode-connection state at this time, the internal resistance is large; thus, the larger the potential of the gate is, the slower the writing procedure is, and during the limited charging time, it is difficult for the potential Vdata+Vth or Vdd+Vth to be written exactly, thus resulting in a relative large difference between the data output from the Integrated Circuit(IC) and the data actually written to the pixel circuit, decreasing the display effect and quality of the display apparatus.

SUMMARY

At least one of embodiments of the present disclosure provides a pixel circuit, a driving method thereof, and a display apparatus, which can reduce the difference between the data output from the Integrated Circuit and the data written to the pixel circuit.

According to one aspect of at least one of embodiments of the present disclosure, there is provided a pixel circuit comprising a first transistor, a second transistor, a third transistor, a fourth transistor, a fifth transistor, a sixth transistor, a seventh transistor, a storage capacitor and a light-emitting element;

a gate of the first transistor is connected to a control line of the light-emitting element, a first electrode of the first transistor is connected to a first voltage, and a second electrode of the first transistor is connected to a first electrode of the third transistor;

a gate of the second transistor is connected to the control line of the light-emitting element, a first electrode of the second transistor is connected to a second electrode of the third transistor, and a second electrode of the second transistor is connected to an anode of the light-emitting element;

a gate of the third transistor is connected to one terminal of the storage capacitor;

a gate of the fourth transistor is connected to a gate line, a first electrode of the fourth transistor is connected to the second electrode of the third transistor, and a second electrode of the fourth transistor is connected to the gate of the third transistor;

a gate of the fifth transistor is connected to the gate line, a first electrode of the fifth transistor is connected to a second electrode of the seventh transistor, and a second electrode of the fifth transistor is connected to a data line;

a gate of the sixth transistor is connected to the gate line, a first electrode of the sixth transistor is connected to an initial voltage, and a second electrode of the sixth transistor is connected to the first electrode of the third transistor;

a gate of the seventh transistor is connected to the control line of the light-emitting element, and a first electrode of the seventh transistor is connected to the first voltage;

the other terminal of the storage capacitor is connected to the second electrode of the seventh transistor;

a cathode of the light-emitting element is connected to a second voltage.

According to another aspect of at least one of embodiments of the present disclosure, there is provided a display apparatus comprising the pixel circuit as described above.

According to a yet aspect of at least one of embodiments of the present disclosure, there is provided a pixel circuit driving method applicable to the pixel circuit as described above, wherein the driving method comprises: turning on the fourth transistor, the fifth transistor and the sixth transistor, so that the third transistor forms a diode connection, and the potentials at the two terminals of the storage capacitor are the data voltage provided by the data line and the sum of the initial voltage and the threshold voltage of the third transistor respectively;

turning off the fourth transistor, the fifth transistor and the sixth transistor, and turning on the first transistor, the second transistor and the seventh transistor, so that the current flowing through the first transistor, the third transistor and the second transistor drives the light-emitting element to emit light.

In the pixel circuit, the driving method thereof, and the display apparatus provided in at least one of embodiments of the present disclosure, the pixel circuit is controlled to be switched on/off and charged/discharged by a plurality of transistors and the storage capacitor, thus reducing the voltage written to the third transistor in the diode connection manner. On the other hand, the current flowing through the third transistor is independent of the threshold voltage of the third transistor and the first voltage; further, since there is no series connection loop formed for the initial voltage, the effect that the inconsistency or drift of the threshold voltage of the third transistor and the IR drop of the initial voltage have on the current flowing through the light-emitting element can be avoided, improving the uniformity of the display luminance of the display apparatus significantly.

DETAILED DESCRIPTION

Hereinafter, clear and complete descriptions will be given to implementations of the present disclosure with reference to accompanying drawings of the present disclosure. Obviously, the embodiments as described are only a part of the embodiments of the present invention, not all of the embodiments of the present invention. All other embodiments obtained by those skilled in the art on the basis of the embodiments of the present disclosure without paying any creative labor belong to the protection scope of the present disclosure.

Figure 1:
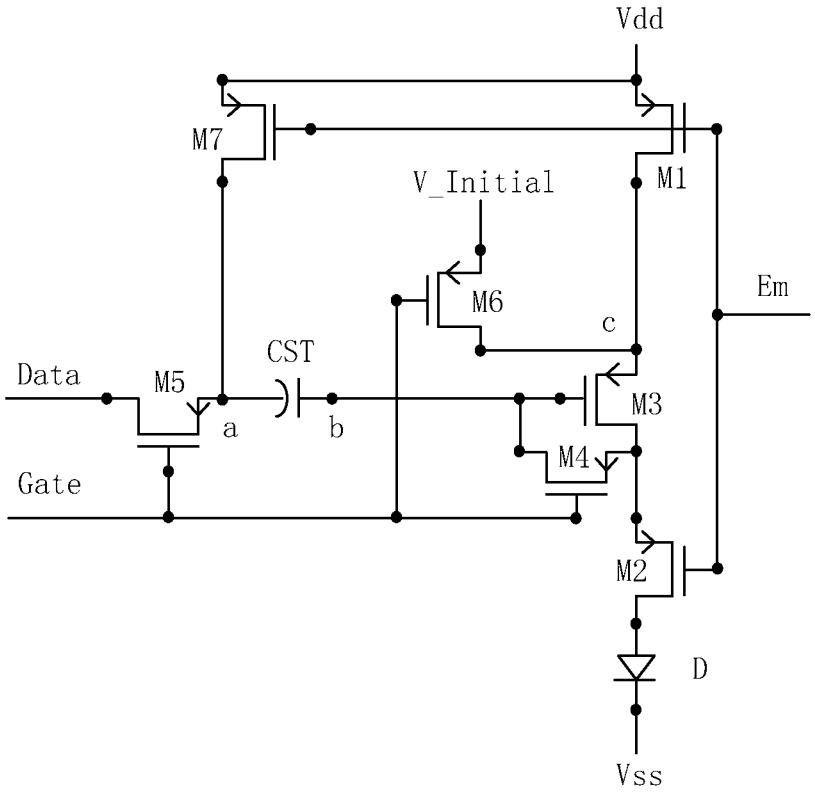
FIG. 1 is a schematic diagram of a structure of a pixel circuit provided in an embodiment of the present disclosure.

FIG. 1 is a schematic diagram of a structure of a pixel circuit provided in an embodiment of the present disclosure. As illustrated in FIG. 1, the pixel circuit comprises:

a first transistor M1, a second transistor M2, a third transistor M3, a fourth transistor M4, a fifth transistor M5, a sixth transistor M6, a seventh transistor M7, a storage capacitor CST and a light-emitting element D.

A gate of the first transistor M1 is connected to a control line Em of the light-emitting element D, a first electrode of the first transistor M1 is connected to a first voltage Vdd, and a second electrode of the first transistor M1 is connected to a first electrode of the third transistor M3.

A gate of the second transistor M2 is connected to the control line Em of the light-emitting element D, a first electrode of the second transistor M2 is connected to a second electrode of the third transistor M3, and a second electrode of the second transistor M2 is connected to an anode of the light-emitting element D. It should be noted that in the embodiments of the present disclosure, the control line Em of the light-emitting element D is configured to input a starting signal, and the light-emitting element D is controlled by the starting signal to emit light.

A gate of the third transistor M3 is connected to one terminal of the storage capacitor CST.

A gate of the fourth transistor M4 is connected to a gate line Gate, a first electrode of the fourth transistor M4 is connected to the second electrode of the third transistor M3, and a second electrode of the fourth transistor M4 is connected to the gate of the third transistor M3.

A gate of the fifth transistor M5 is connected to the gate line Gate, a first electrode of the fifth transistor M5 is connected to a second electrode of the seventh transistor M7, and a second electrode of the fifth transistor M5 is connected to a data line Data.

A gate of the sixth transistor M6 is connected to the gate line Gate, a first electrode of the sixth transistor M6 is connected to an initial voltage V_initial, and a second electrode of the sixth transistor M6 is connected to the first electrode of the third transistor M3.

A gate of the seventh transistor M7 is connected to the control line Em of the light-emitting element D, and a first electrode of the seventh transistor M7 is connected to the first voltage Vdd.

The other terminal of the storage capacitor CST is connected to the second electrode of the seventh transistor M7.

A cathode of the light-emitting element D is connected to a second voltage Vss.

It should be noted that in the embodiment of the present disclosure, the light-emitting element D can be a known current-driving type light-emitting element comprising a Light Emitting Diode(LED) or an OLED. In the embodiments of the present disclosure, the OLED is taken as an example for illustration.

In the pixel circuit provided in the embodiment of the present disclosure, the pixel circuit is controlled to be switched on/off and charged/discharged by a plurality of transistors and the storage capacitor, thus reducing the voltage written to the third transistor in the diode connection manner. On the other hand, the current flowing through the third transistor is independent of the threshold voltage of the third transistor and the first voltage; further, since there is no series connection loop formed for the initial voltage, the effect that the inconsistency or drift of the threshold voltage of the third transistor and the IR drop of the initial voltage have on the current flowing through the light-emitting element can be avoided, improving the uniformity of the display luminance of the display apparatus significantly.

It should be noted that in the embodiments of the present disclosure, the first voltage Vdd can be a high voltage, the second voltage Vss can be a low voltage or an earth terminal voltage.

Herein, the first transistor M1, the second transistor M2, the third transistor M3, the fourth transistor M4, the fifth transistor M5, the sixth transistor M6 and the seventh transistor M7 are all N type transistors; or the first transistor M1, the second transistor M2, and the seventh transistor M7 are all N type transistors; the third transistor M3, the fourth transistor M4, the fifth transistor M5, and the sixth transistor M6 are all P type transistors; or the first transistor M1, the second transistor M2, the third transistor M3, the fourth transistor M4, the fifth transistor M5, the sixth transistor M6 and the seventh transistor M7 are all P type transistors; or the first transistor M1, the second transistor M2, and the seventh transistor M7 are all P type transistors; the third transistor M3, the fourth transistor M4, the fifth transistor M5, and the sixth transistor M6 are all N type transistors. In a case in which different type transistors are adopted, external control signals of the pixel circuit are different accordingly.

For example, taking P type transistors as an example, in the pixel circuit of the present disclosure, the first transistor M1, the second transistor M2, the third transistor M3, the fourth transistor M4, the fifth transistor M5, the sixth transistor M6 and the seventh transistor M7 may all be P type enhancement Thin Film Transistors(TFTs) or P type depletion TFTs. Herein, the first electrodes of the first transistor M1, the second transistor M2, the third transistor M3, the fourth transistor M4, the fifth transistor M5, the sixth transistor M6 and the seventh transistor M7 are sources, and the second electrodes thereof are drains.

Hereinafter, taking a case in which the first transistor M1, the second transistor M2, the third transistor M3, the fourth transistor M4, the fifth transistor M5, the sixth transistor M6 and the seventh transistor M7 are all P type enhancement TFTs as an example, a detailed description will be given to the operating procedure of the pixel circuit provided in the embodiment of the disclosure.

Figure 2:
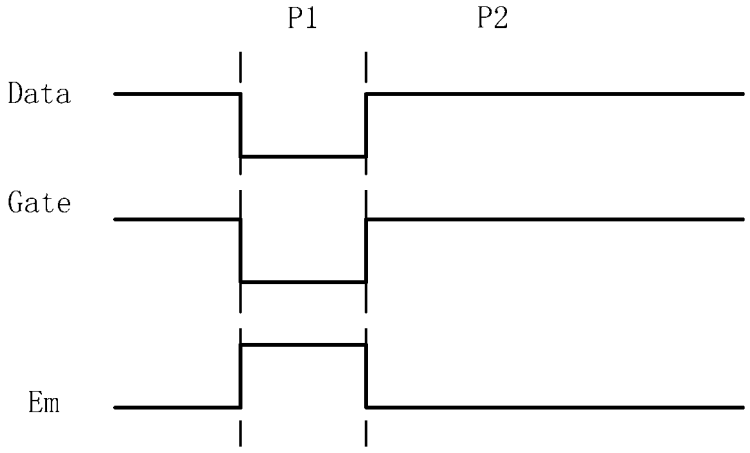
FIG. 2 is a timing sequence diagram of a pixel circuit in operation which is provided in an embodiment of the present disclosure.

When the pixel circuit illustrated in FIG. 1 operates, the operating procedure can be divided into two phases particularly, i.e., a writing phase and a light-emitting phase. FIG. 2 is a timing sequence diagram of respective signal lines during the operating procedure of the pixel circuit illustrated in FIG. 1. As illustrated in FIG. 2, P1 and P2 represent the writing phase and the light-emitting phase respectively.

Figure 3:
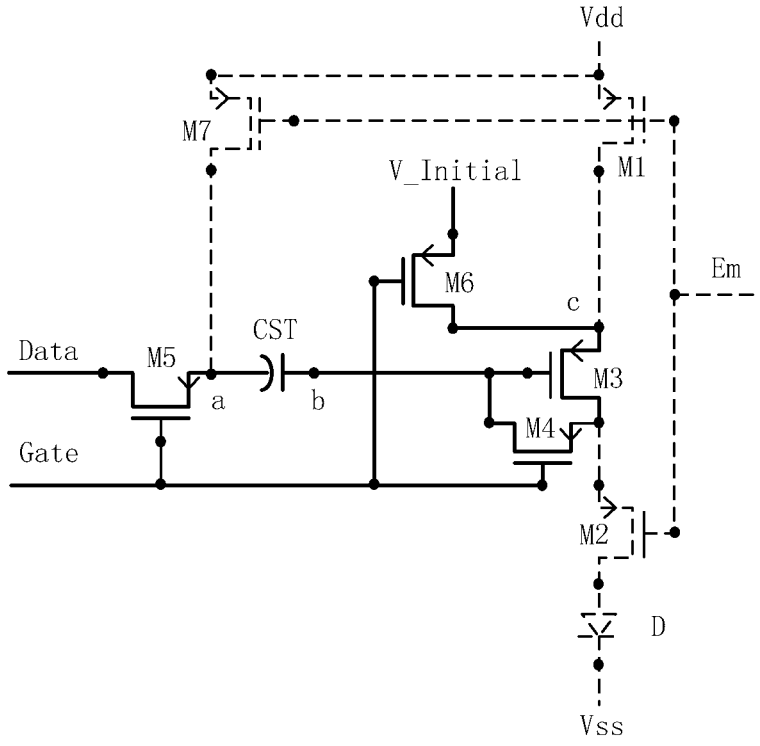
FIG. 3 is a schematic diagram of an equivalent circuit of the pixel circuit illustrated in FIG. 1 in a writing phase.

FIG. 3 is a schematic diagram of an equivalent circuit of the pixel circuit illustrated in FIG. 1 during the writing phase P1. As illustrated in FIG. 3, the wires and the elements which are turned on are denoted by solid lines, and the units which are not turned on are denoted by dotted lines; the same denotation is adopted in the following equivalent circuit diagrams. During the writing phase P1, the data line Data inputs a data voltage(Vdata) at a low level and the gate line Gate inputs a voltage at a low level, and the control line Em of the light-emitting element D inputs a high level signal. As illustrated in FIG. 3, the fifth transistor M5, the sixth transistor M6 and the fourth transistor M4 are turned on, and the first transistor M1, the second transistor M2 and the seventh transistor M7 are turned off. After the sixth transistor M6 is turned on, the initial voltage V_initial is inputted to a node C where the second electrode of the sixth transistor M6 and the first electrode of the third transistor M3 are connected; at the same time, since the fourth transistor M4 is turned on, the gate and the second electrode of the third transistor M3 are connected together, so that the third transistor M3 forms a diode connection. At this time, the voltage at a node b, where the gate of the third transistor M3 and one terminal of the storage capacitor CST are connected, is increased to V_initial+Vth, after the initial voltage V_initial passes the third transistor M3, wherein Vth represents the threshold voltage of the third transistor M3. In a case in which the initial voltage V_initial is very low, or is at zero (for example, in a case in which the minimum data voltage (Vdata) and the threshold voltage Vth of the third transistor M3 are greater than zero, the initial voltage V_initial can be set as zero so as to achieve the function of resetting the voltage at a corresponding node), the voltage actually written to the node b is Vth. Thus, in the pixel circuit provided in the embodiment of the present disclosure, the potential at the gate of the third transistor M3 (i.e., the driving transistor in the pixel circuit) can be decreased during the writing phase P1, and meantime the difference between the data output from the IC and the data written to the pixel circuit can be reduced, thus the writing operation is easier and more accurate.

Further, after the fifth transistor M5 is turned on, the data line Data inputs the data voltage(Vdata) to a node a at the other terminal of the storage capacitor CST where the second electrode of the seventh transistor M7 and the first electrode of the fifth transistor M5 are connected. At this time, the potentials at two terminals of the storage capacitor CST are Vdata at the node a and V_initial+Vth at the node b respectively. Therefore, the potential difference across the storage capacitor CST is Vdata−(V_initial+Vth).

Figure 4:
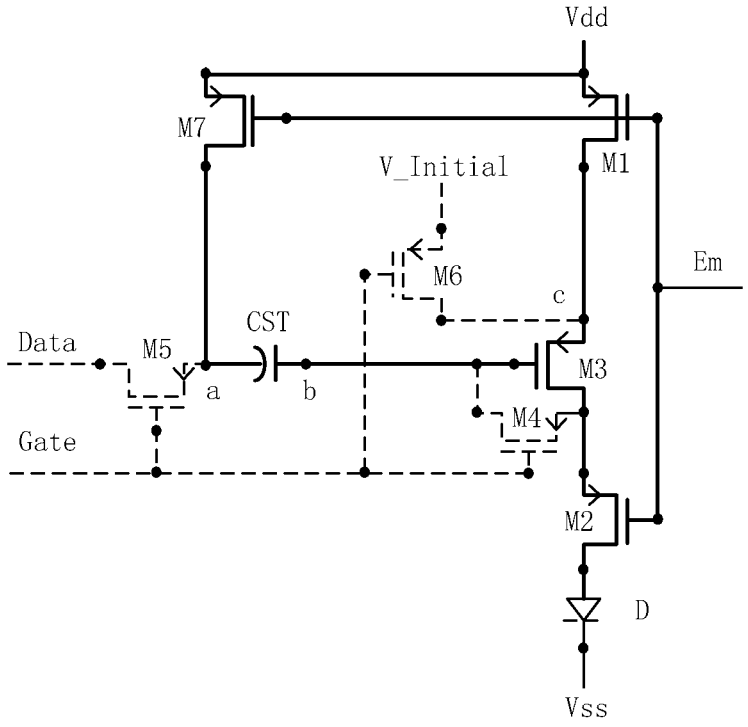
FIG. 4 is a schematic diagram of an equivalent circuit of the pixel circuit illustrated in FIG. 1 in a light-emitting phase.

FIG. 4 is a schematic diagram of an equivalent circuit of the pixel circuit illustrated in FIG. 1 during the light-emitting phase P2. As illustrated in FIG. 4, during the light-emitting phase P2, the data line Data inputs the data voltage(Vdata) at a high level and the gate line Gate inputs a voltage at a high level, and the control line Em of the light-emitting element D inputs a low level signal. The first transistor M1, the second transistor M2 and the seventh transistor M7 are turned on. After the seventh transistor M7 is turned on, the potential at the node a is Vdd; according to the charge retention principle of the storage capacitor CST, the potential at the node b is Vdd−[Vdata−(V_initial+Vth)]. After the first transistor M1 and the second transistor M2 are turned on, the potential at the node c is Vdd. At this time, the current flowing through the third transistor M3 drives the OLED to emit light. Since the third transistor M3 is in a saturation region, the current flowing through the third transistor M3 can be obtained from the current characteristics of the TFT in the saturation region:

$$\begin{aligned} Ids &= 1/2 \times K \times (Vgs - Vth)^2 \\ &= 1/2 \times K \times \{Vdd - [Vdata - (\text{V_inital} + Vth)] - Vdd - Vth\}^2 \\ &= 1/2 \times K \times (-Vdata + \text{V_inital})^2 \end{aligned}$$

wherein K represents the current constant related to the third transistor M3, Vgs represents the gate-source voltage of the third transistor M3, that is, the voltage of the node b with respect to the node c, and Vth represents the threshold voltage of the third transistor M3. In general, Vth varies from a pixel unit to another pixel unit, and the Vth of the same pixel might drift with time, which renders difference in display luminance; since such a difference relates to the image as previously displayed, image sticking phenomenon often occurs.

It can be seen that the current Ids flowing through the third transistor M3 is independent of the first voltage Vdd and the threshold voltage Vth of the third transistor M3. Further, in a case in which the initial voltage V_initial is a zero voltage, the current Ids only depends on the data voltage Vdata output from the data line Data. Moreover, since there is no series connection loop formed for the initial voltage V_initial, the effect that the inconsistency or drift of the threshold voltage Vth of the third transistor M3 and the IR drop of the initial voltage V_initial have on the current flowing through the light-emitting element can be avoided, thus improving the uniformity of the luminance of the display apparatus in display significantly, and preventing the image-sticking phenomenon occurring.

It should be noted that the above embodiments are described by taking a case in which all the transistors are all P type enhancement TFTs as an example. Optionally, P type depletion TFTs can be adopted as all the transistors, and the difference is in that for an enhancement TFT, the threshold voltage Vth is a positive value, and for a depletion TFT, the threshold voltage Vth is a negative value.

Further, the first transistor M1, the second transistor M2, the third transistor M3, the fourth transistor M4, the fifth transistor M5, the sixth transistor M6 and the seventh transistor M7 may all be N type transistors. The timing sequence of the external signals for driving a pixel circuit adopting such a structure is adjusted accordingly, wherein the timing sequence of the data line Data, the gate line Gate and the control line Em of the light-emitting element D is inverted to that of corresponding signals illustrated in FIG. 2, that is, there is a phase difference of 180 degrees therebetween.

Optionally, the first transistor M1, the second transistor M2, and the seventh transistor M7 are all N type transistors, and the third transistor M3, the fourth transistor M4, the fifth transistor M5, and the sixth transistor M6 are P type transistors. The timing sequence of the external signals for driving a pixel circuit adopting such a structure is adjusted accordingly, wherein the timing sequence of the control line Em of the light-emitting element D is inverted to that of the corresponding signal illustrated in FIG. 2, that is, there is a phase difference of 180 degrees therebetween.

Optionally, the first transistor M1, the second transistor M2, and the seventh transistor M7 are all P type transistors, and the third transistor M3, the fourth transistor M4, the fifth transistor M5, and the sixth transistor M6 are N type transistors. The timing sequence of the external signals for driving a pixel circuit adopting such a structure is adjusted accordingly, wherein the timing sequence of the data line Data and the gate line Gate is inverted to that of the corresponding signals illustrated in FIG. 2, that is, there is a phase difference of 180 degrees therebetween.

An embodiment of the present disclosure further provides a display apparatus comprising any one of the pixel circuits as described above, wherein the display apparatus can comprise an array of a plurality of pixel units each comprising any one of the pixel circuit as described above, with the same beneficial effect as that of the pixel circuit as provided in the aforementioned embodiments of the present disclosure. Since the pixel circuit has been described in the above embodiments in detail, and the repeated description is omitted.

In particular, the display apparatus provided in the embodiments of the present disclosure can be a display apparatus having a light-emitting element driven by current, such as a LED display, OLED display or the like.

In the display apparatus provided in the embodiment of the present disclosure, a plurality of pixel circuits are included therein, wherein the pixel circuit is controlled to be switched on/off and charged/discharged by a plurality of transistors and the storage capacitor, thus reducing the voltage written to the third transistor in the diode connection manner. On the other hand, the current flowing through the third transistor is independent of the threshold voltage of the third transistor and the first voltage; further, since there is no series connection loop formed for the initial voltage, the effect that the inconsistency or drift of the threshold voltage of the third transistor and the IR drop of the initial voltage have on the current flowing through the light-emitting element can be avoided, improving the uniformity of the display luminance of the display apparatus significantly.

Figure 5:
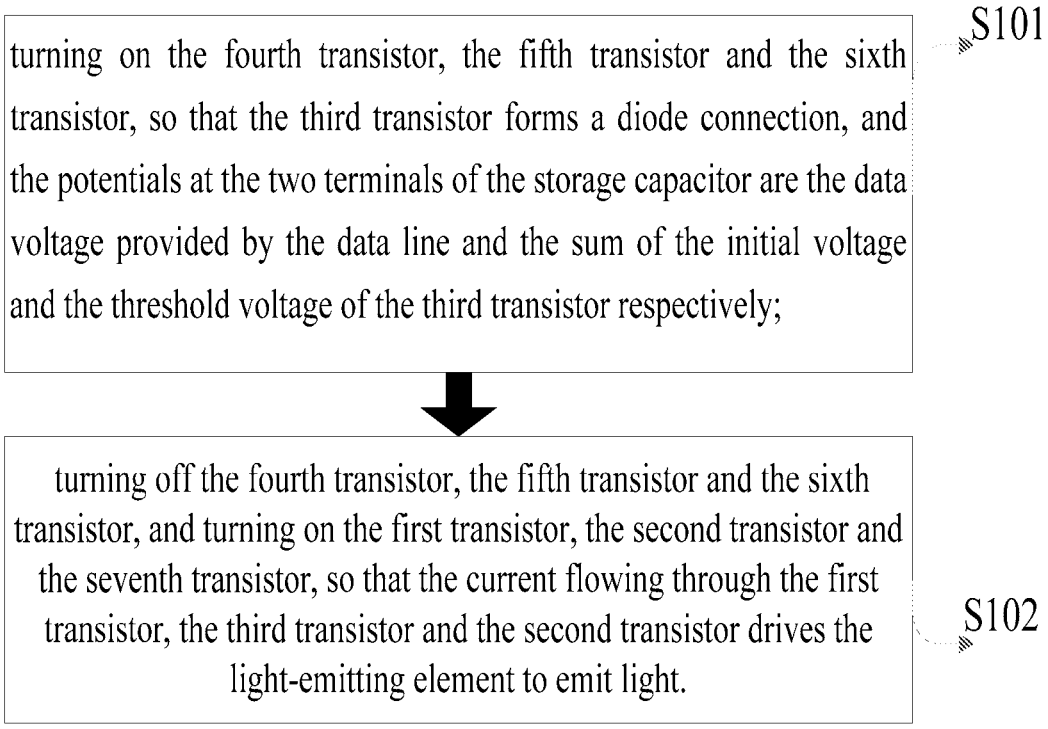
FIG. 5 is a schematic flowchart of a driving method for a pixel circuit provided in an embodiment of the present disclosure.

FIG. 5 is a schematic flowchart of a driving method for a pixel circuit provided in an embodiment of the present disclosure. The driving method for the pixel circuit can be applied to the pixel circuit provided in the above embodiments. As illustrated in FIG. 5, the method comprises steps of:

S101: turning on the fourth transistor M4, the fifth transistor M5 and the sixth transistor M6, so that the third transistor M3 forms a diode connection, and the potentials at the two terminals of the storage capacitor CST are the data voltage Vdata and the sum of the initial voltage V_initial and the threshold voltage Vth of the third transistor M3 respectively;

S102: turning off the fourth transistor M4, the fifth transistor M5 and the sixth transistor M6, and turning on the first transistor M1, the second transistor M2 and the seventh transistor M7, so that the current flowing through the first transistor M1, the third transistor M3 and the second transistor M2 drives the light-emitting element D to emit light.

In the driving method for the pixel circuit provided in the embodiment of the present disclosure, the pixel circuit is controlled to be switched on/off and charged/discharged by a plurality of transistors and the storage capacitor, thus reducing the voltage written to the third transistor in the diode connection manner. On the other hand, the current flowing through the third transistor is independent of the threshold voltage of the third transistor and the first voltage; further, since there is no series connection loop formed for the initial voltage, the effect that the inconsistency or drift of the threshold voltage of the third transistor and the IR drop of the initial voltage have on the current flowing through the light-emitting element can be avoided, improving the uniformity of the display luminance of the display apparatus significantly.

It should be noted that in the embodiment of the present disclosure, the light-emitting element D can be a known current-driving type light-emitting element such as a Light Emitting Diode(LED) or an OLED.

Herein, the first transistor M1, the second transistor M2, the third transistor M3, the fourth transistor M4, the fifth transistor M5, the sixth transistor M6 and the seventh transistor M7 are all N type transistors; or the first transistor M1, the second transistor M2, and the seventh transistor M7 are all N type transistors; the third transistor M3, the fourth transistor M4, the fifth transistor M5, and the sixth transistor M6 are all P type transistors; or the first transistor M1, the second transistor M2, the third transistor M3, the fourth transistor M4, the fifth transistor M5, the sixth transistor M6 and the seventh transistor M7 are all P type transistors; or the first transistor M1, the second transistor M2, and the seventh transistor M7 are all P type transistors; the third transistor M3, the fourth transistor M4, the fifth transistor M5, and the sixth transistor M6 are all N type transistors. In a case in which different type transistors are adopted, external control signals of the pixel circuit are different accordingly.

For example, taking P type transistors as an example, in the pixel circuit of the present disclosure, the first transistor M1, the second transistor M2, the third transistor M3, the fourth transistor M4, the fifth transistor M5, the sixth transistor M6 and the seventh transistor M7 may all be P type enhancement TFTs or P type depletion TFTs.

It should be noted that in a case in which the first transistor M1, the second transistor M2, the third transistor M3, the fourth transistor M4, the fifth transistor M5, the sixth transistor M6 and the seventh transistor M7 are all P type enhancement TFTs, the timing sequence of the control signals is illustrated in FIG. 2, wherein during the writing phase P1, the data line Data inputs a data voltage(Vdata) at a low level and the gate line Gate inputs a voltage at a low level, and the control line Em of the light-emitting element D inputs a high level signal; and during the light-emitting phase P2, the data line Data inputs the data voltage(Vdata) at a high level and the gate line Gate inputs a voltage at a high level, and the control line Em of the light-emitting element D inputs a low level signal.

For instance, in a case in which the first transistor M1, the second transistor M2, the third transistor M3, the fourth transistor M4, the fifth transistor M5, the sixth transistor M6 and the seventh transistor M7 are all P type enhancement TFTs, the step S101 corresponds to the writing phase P1, and the equivalent circuit diagram of the pixel circuit during this phase is illustrated in FIG. 3. Herein, the wires and the elements which are turned on are denoted by solid lines, and the units which are not turned on are denoted by dotted lines; the same denotation is adopted in the following equivalent circuit diagrams. During the writing phase P1, the data line Data inputs a data voltage(Vdata) at a low level and the gate line Gate inputs a voltage at a low level, and the control line Em of the light-emitting element D inputs a high level signal. As illustrated in FIG. 3, the fifth transistor M5, the sixth transistor M6 and the fourth transistor M4 are turned on, and the first transistor M1, the second transistor M2 and the seventh transistor M7 are turned off. After the sixth transistor M6 is turned on, the initial voltage V_initial is inputted to the node c; at the same time, since the fourth transistor M4 is turned on, the gate and the second electrode of the third transistor M3 are connected together, so that the third transistor M3 forms a diode connection. At this time, the voltage at the node b, where the gate of the third transistor M3 and one terminal of the storage capacitor CST are connected, is increased to V_initial+Vth, after the initial voltage V_initial passes the third transistor M3, wherein Vth represents the threshold voltage of the third transistor M3. In a case in which the initial voltage V_initial is very low, or is at zero (for example, in a case in which the minimum data voltage (Vdata) and the threshold voltage Vth of the third transistor M3 are greater than zero, the initial voltage V_initial can be set as zero so as to achieve the function of resetting the voltage at a corresponding node), the voltage actually written to the node b is Vth. Thus, in the pixel circuit provided in the embodiment of the present disclosure, the potential at the gate of the third transistor M3 can be decreased during the writing phase P1, and meantime the difference between the data output from the IC and the data written to the pixel circuit can be reduced, thus the writing operation is easier and more accurate.

Further, after the fifth transistor M5 is turned on, the data line Data inputs the data voltage(Vdata) to the node a, i.e., the other terminal of the storage capacitor CST. At this time, the potentials at two terminals of the storage capacitor CST are Vdata at the node a and V_initial+Vth at the node b respectively. Therefore, the potential difference across the storage capacitor CST is Vdata−(V_initial+Vth).

Accordingly, the step S102 corresponds to the light-emitting phase P2, and the equivalent circuit diagram of the pixel circuit during this phase is illustrated in FIG. 4. During this phase, the data line Data inputs the data voltage(Vdata) at a high level and the gate line Gate inputs a voltage at a high level, and the control line Em of the light-emitting element D inputs a low level signal. The first transistor M1, the second transistor M2 and the seventh transistor M7 are turned on. After the seventh transistor M7 is turned on, the potential at the node a is Vdd; according to the charge retention principle of the storage capacitor CST, the potential at the node b is Vdd−[Vdata−(V_initial+Vth)]. After the first transistor M1 and the second transistor M2 are turned on, the potential at the node c is Vdd. At this time, the current flowing through the third transistor M3 drives the OLED to emit light. Since the third transistor M3 is in a saturation region, the current flowing through the third transistor M3 can be obtained from the current characteristics of the TFT in the saturation region:

$$\begin{aligned} Ids &= 1/2 \times K \times (Vgs - Vth)^2 \\ &= 1/2 \times K \times \{Vdd - [Vdata - (\text{V_inital} + Vth)] - Vdd - Vth\}^2 \\ &= 1/2 \times K \times (-Vdata + \text{V_inital})^2 \end{aligned}$$

wherein K represents the current constant related to the third transistor M3, Vgs represents the gate-source voltage of the third transistor M3, that is, the voltage of the node b with respect to the node c, and Vth represents the threshold voltage of the third transistor M3. In general, Vth varies from a pixel unit to another pixel unit, and the Vth of a same pixel might drift with time, which renders difference in display luminance; since such a difference relates to the image as previously displayed, image sticking phenomenon often occurs.

It can be seen that the current Ids flowing through the third transistor M3 is independent of the first voltage Vdd and the threshold voltage Vth of the third transistor M3. Further, in a case in which the initial voltage V_initial is a zero voltage, the current Ids only depends on the data voltage Vdata output from the data line Data. Moreover, since there is no series connection loop formed for the initial voltage V_initial, the effect that the inconsistency or drift of the threshold voltage Vth of the third transistor M3 and the IR drop of the initial voltage V_initial have on the current flowing through the light-emitting element can be avoided, thus improving the uniformity of the luminance of the display apparatus in display significantly, and preventing the image-sticking phenomenon occurring.

Those skilled in the art can understand that all or part of steps in the above method/process embodiments can be implemented through hardware instructed by associated computer program. The associated computer program can be stored in a computer readable storage medium, and, when being executed, the steps in the above method/process embodiments are performed. The storage medium can include any kind of medium capable of storing program codes such as ROM, RAM, magnetic disc, optical disc, etc.

The above descriptions are only implementations of the present disclosure, and in no way limit the scope of the present invention. It will be obvious that those skilled in the art may readily conceive variations and equivalences to the above embodiments without departing from the spirit and scope of the present invention as defined by the following claims. Such variations and modifications are intended to be included within the scope of the present invention. The protection scope of the present invention should be defined by the attached claims.

The present application claims the priority of a Chinese application filed on May 30, 2014, with No. 201410238690.4, and the disclosure of which is entirely incorporated herein by reference.

What is claimed is:

1. A pixel circuit comprising a first transistor, a second transistor, a third transistor, a fourth transistor, a fifth transistor, a sixth transistor, a seventh transistor, a storage capacitor and a light-emitting element;

a gate of the first transistor is connected to a control line of the light-emitting element, a first electrode of the first transistor is connected to a first voltage, and a second electrode of the first transistor is connected to a first electrode of the third transistor;

a gate of the second transistor is connected to the control line of the light-emitting element, a first electrode of the second transistor is connected to a second electrode of the third transistor, and a second electrode of the second transistor is connected to an anode of the light-emitting element;

a gate of the third transistor is connected to one terminal of the storage capacitor;

a gate of the fourth transistor is connected to a gate line, a first electrode of the fourth transistor is connected to the second electrode of the third transistor, and a second electrode of the fourth transistor is connected to the gate of the third transistor;

a gate of the fifth transistor is connected to the gate line, a first electrode of the fifth transistor is connected to a second electrode of the seventh transistor, and a second electrode of the fifth transistor is connected to a data line;

a gate of the sixth transistor is connected to the gate line, a first electrode of the sixth transistor is connected to an initial voltage, and a second electrode of the sixth transistor is connected to the first electrode of the third transistor;

a gate of the seventh transistor is connected to the control line of the light-emitting element, and a first electrode of the seventh transistor is connected to the first voltage;

the other terminal of the storage capacitor is connected to the second electrode of the seventh transistor; and a cathode of the light-emitting element is connected to a second voltage.

2. The pixel circuit of claim 1, wherein the first transistor, the second transistor, the third transistor, the fourth transistor, the fifth transistor, the sixth transistor and the seventh transistor are all N type transistors.

3. The pixel circuit of claim 2, wherein the transistors comprise enhancement type Thin Film Transistors(TFTs) or depletion type TFTs.

4. The pixel circuit of claim 2, wherein the light-emitting element is an Organic Light-Emitting Diode.

5. The pixel circuit of claim 1, wherein the first transistor, the second transistor, and the seventh transistor are all N type transistors; and the third transistor, the fourth transistor, the fifth transistor, and the sixth transistor are all P type transistors.

6. The pixel circuit of claim 1, wherein the first transistor, the second transistor, the third transistor, the fourth transistor, the fifth transistor, the sixth transistor and the seventh transistor are all P type transistors.

7. The pixel circuit of claim 6, wherein the first electrodes of the first transistor, the second transistor, the third transistor, the fourth transistor, the fifth transistor, the sixth transistor and the seventh transistor are sources, and the second electrodes thereof are drains.

8. The pixel circuit of claim 1, wherein the first transistor, the second transistor, and the seventh transistor are all P type transistors; the third transistor, the fourth transistor, the fifth transistor, and the sixth transistor are all N type transistors.

9. The pixel circuit of claim 1, wherein the transistors comprise enhancement type Thin Film Transistors(TFTs) or depletion type TFTs.

10. The pixel circuit of claim 1, wherein the light-emitting element is an Organic Light-Emitting Diode.

11. A display apparatus comprising the pixel circuit of claim 1.

12. A pixel circuit driving method applicable to the pixel circuit of claim 1, the method comprising:

turning on the fourth transistor, the fifth transistor and the sixth transistor, so that the third transistor forms a diode connection, and potentials at two terminals of the storage capacitor are the data voltage provided by the data line and a sum of the initial voltage and a threshold voltage of the third transistor respectively; and turning off the fourth transistor, the fifth transistor and the sixth transistor, and turning on the first transistor, the second transistor and the seventh transistor, so that a current flowing through the first transistor, the third transistor and the second transistor drives the light-emitting element to emit light.

13. The pixel circuit driving method of claim 12, wherein the first transistor, the second transistor, the third transistor, the fourth transistor, the fifth transistor, the sixth transistor and the seventh transistor are all N type transistors.

14. The pixel circuit driving method of claim 12, wherein the first transistor, the second transistor, and the seventh transistor are all N type transistors; and the third transistor, the fourth transistor, the fifth transistor, and the sixth transistor are all P type transistors.

15. The pixel circuit driving method of claim 12, wherein the first transistor, the second transistor, the third transistor, the fourth transistor, the fifth transistor, the sixth transistor and the seventh transistor are all P type transistors.

16. The pixel circuit driving method of claim 15, wherein the first electrodes of the first transistor, the second transistor, the third transistor, the fourth transistor, the fifth transistor, the sixth transistor and the seventh transistor are sources, and the second electrodes thereof are drains.

17. The pixel circuit driving method of claim 12, wherein the first transistor, the second transistor, and the seventh transistor are all P type transistors; the third transistor, the fourth transistor, the fifth transistor, and the sixth transistor are all N type transistors.

18. The pixel circuit driving method of claim 12, wherein the transistors comprise enhancement type Thin Film Transistors(TFTs) or depletion type TFTs.

19. The pixel circuit driving method of claim 12, wherein the light-emitting element is an Organic Light-Emitting Diode.

20. The pixel circuit driving method of claim 12, wherein in a case in which the first transistor, the second transistor, the third transistor, the fourth transistor, the fifth transistor, the sixth transistor and the seventh transistor are all P type enhancement TFTs, a timing sequence of control signals comprises:

a writing phase, in which the data line inputs a data voltage at a low level and the gate line inputs a voltage at a low level, and the control line of the light-emitting element inputs a high level; and a light-emitting phase, in which the data line inputs the data voltage at a high level and the gate line inputs a voltage at a high level, and the control line of the light-emitting element inputs a low level.

* * * * *